United States Patent [19]

Richardson

[11] Patent Number: 5,002,320

[45] Date of Patent: Mar. 26, 1991

[54] SLIDING HOLD-OPEN

[75] Inventor: Richard J. Richardson, Simi Valley, Calif.

[73] Assignee: Anthony's Manufacturing Co., Inc., San Fernando, Calif.

[21] Appl. No.: 528,719

[22] Filed: May 24, 1990

[51] Int. Cl.[5] ..... E05C 17/30

[52] U.S. Cl. ..... 292/275; 292/277; 292/338; 292/DIG. 71

[58] Field of Search ..... 292/275, 262, 338, DIG. 4, 292/278, 277, 263, 70–74; 16/86 A, 86 C, 350, 360, 337; 248/240, 242, 204.4

[56] References Cited

U.S. PATENT DOCUMENTS

| | | | |
|---|---|---|---|
| 1,713,562 | 5/1929 | Sibley | 292/275 |
| 2,996,210 | 8/1961 | Thomas | 292/278 |
| 3,064,846 | 11/1962 | Thomas | 292/263 |
| 4,932,695 | 6/1990 | Pettit et al. | 292/338 |

FOREIGN PATENT DOCUMENTS

| | | | |
|---|---|---|---|
| 555642 | 7/1923 | France | 292/263 |
| 833932 | 5/1960 | United Kingdom | 292/278 |

*Primary Examiner*—Eric K. Nicholson
*Assistant Examiner*—D. Boucher
*Attorney, Agent, or Firm*—Poms, Smith et al.

[57] ABSTRACT

A hold-open for a refrigerator display case door having two slotted elongated members which are connected for linear sliding engaging on their respective inside surfaces. The inside surfaces of each elongated member is provided with a raised impediment which contact and ride over each other when the door is opened a sufficient amount, and thus place the door in a hold-open position.

10 Claims, 2 Drawing Sheets

SLIDING HOLD-OPEN

BACKGROUND OF THE INVENTION

1. Field of the Invention

This invention pertains in general to hardware for door opening, closing and holding open and in particular to devices for releasably holding open doors.

2. Description of Related Art

Devices for stopping the opening movement of a door hinged to a door frame and/or for holding doors open at a pre-determined position have application in many fields. For example, the automotive industry makes widespread use of such devices as evidenced by U.S. Pat. No. 3,710,417 to Berman, et al., and U.S. Pat. No. 2,893,050 to Hollanswoth.

Similarly, the cabinet making art frequently relies upon hinges which incorporate some means for stopping and/or holding a cabinet door at a predetermined open position. Examples of this art are to be found in, for example, the disclosure of Tuerk, in U.S. Pat. No. 313,457; Hoffman in U.S. Pat. No. 644,203; or to Gorgon, et al., in U.S. Pat. No. 3,262,149.

One field to which such devices are particularly applicable is that of hinged appliance doors, for example refrigerator doors and more particularly to refrigerator display units such as those which are found in supermarkets and self-service stores. In this latter field, it is desirable to have a large, typically doubleglazed door stopped and retained at an open position of about 90° so that customers and/or stocking clerks can access the refrigerated contents of the case conveniently for selection for purchases or for stocking. These doors typically are hinged separately and may incorporate an automatic return mechanism separately. Thus, it is desirable to have a mechanism which will retain the door in the open position by a force of a predetermined amount slightly more than that exerted by the closing mechanism, which hold-open force can be easily overcome by the application of a small, external manual closing force.

The present invention is, therefore, the provision of a hold-open for a door hingeably attached to a door frame. It is a further object of the present invention to provide such a device that is simple, inexpensive to fabricate, and easy to install, but which is smooth and reliable in operation and able to withstand the rigors of hard use.

SUMMARY OF THE INVENTION

These objects are preferably accomplished in a device comprising a first elongated member having a slot along its length and having just beyond the slot an impediment. The first elongated member also has an aperture at one end to be used for attachment to a door. A second elongated member has a track along its entire length with a slot located inside the track and an impediment located within the track just beyond the slot. The second elongated member also has an aperture at one end for attachment to a door frame. The elongated members are slideably attached to each other by guides and fasteners which are fixedly attached to one elongated member and provides a guide rod extending into the slot in the other member. The guide and guide rod may include a resilient and compressible member, such as an O-ring. When the two members are attached to one another by the slidable attachment means, the two elongated members freely slide along each other extending the device until the two impediments come into contact. At that point, a force must be applied in the direction which extends the device which is sufficient to compress the O-rings to allow for the two elongated members to separate far enough for the impediment means to ride over each other. Once the impediment means have passed each other by, the hold-open is then secured in an open position. The hold-open can then be returned to its free moving or closed position by applying sufficient force to again compress the O-rings and the two slideably attaching means sufficient to again allow the two elongated members to separate far enough for the two impediments to ride over each other.

A more complete understanding of the device and its objects and advantages will become evident to those skilled in the art from a consideration of the following detailed description of the preferred embodiments, when read in conjunction with the appended drawings, a brief description of which follows.

BRIEF DESCRIPTION OF THE DRAWINGS

FIG. 1 shows the exemplary embodiment of the device 10 in association with an appliance door 2 hingeably attached by means of a conventional hinge 3 to a door frame 4 for right hand opening, such as may be found in a commercial grade, refrigerated display case. In such a display case, door 2 may be provided with insulated, double glazing 5 for product visibility.

As shown in FIG. 6, a preferred exemplary embodiment of the present invention includes a first elongated member 12 and a second elongated member 14. The two members are slideably attached to each other by a first slidable connector 16 and a second slidable connector 18. Each elongated member also has an impediment 20, 22 located on their inside surfaces, which are the surfaces that face towards the other elongated member. The slidable connectors 116 and 18 serve as a fastener and as a guide. They serve as fasteners by holding the two elongated members 12 and 14 in an adjacent sliding relationship. The slidable connectors 16 and 18 also serve as guides by limiting the sliding action to a back and forth linear extension and retraction.

Figure 1:
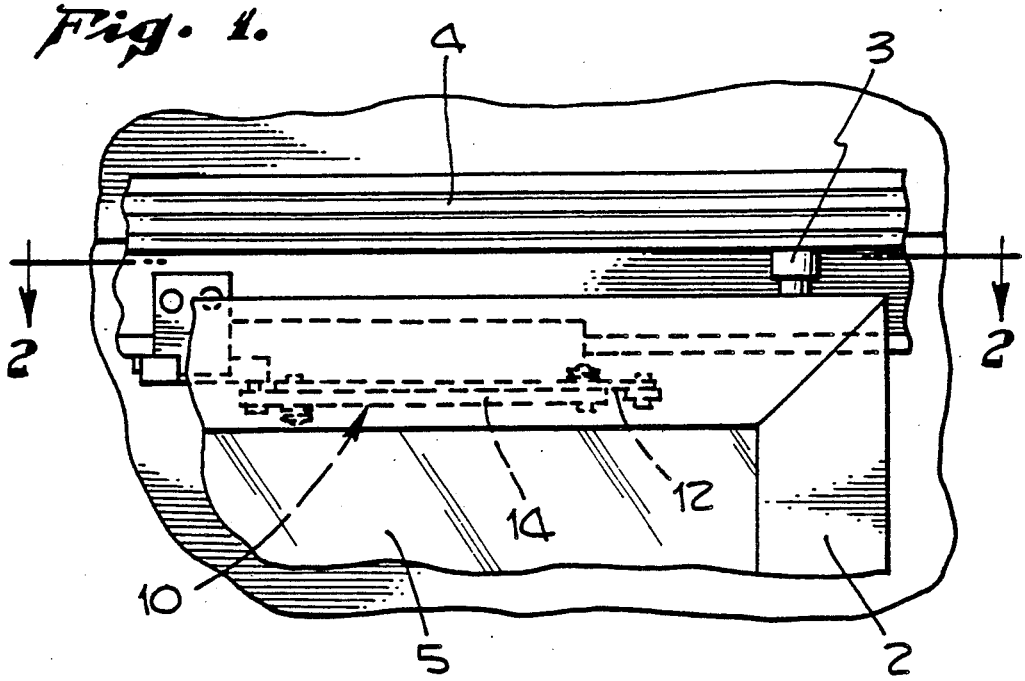
FIG. 1 is a plan view of an appliance door hingeably attached to a door frame with a preferred embodiment of the device of the instant invention shown in dotted outline.
Figure 2:
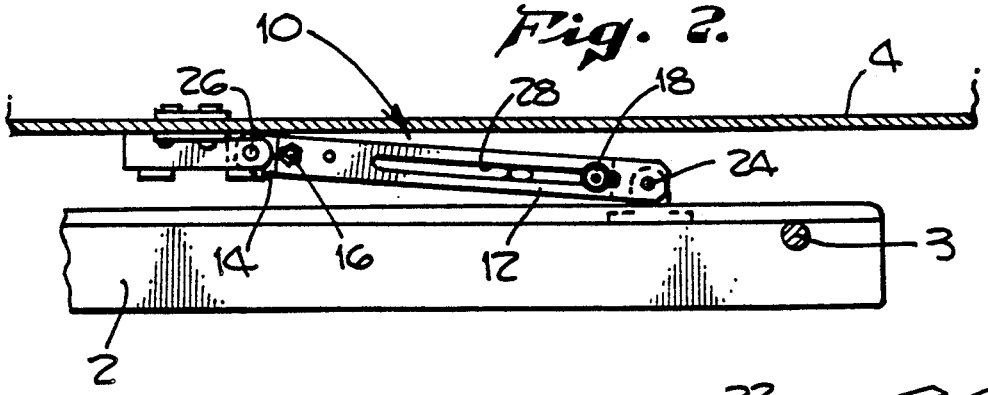
FIG. 2 is a top view of the device as revealed by the view 2—2 taken in FIG. 1.

The first elongated member 12 also has an opening 24 which can be used in conjunction with a connector and a bracket to attach the first member 12 to a door 2 or door frame 4 so that the device may pivot about the connector. Similarly, the second member 14 has an opening 26 which can also be used in conjunction with a connector and a bracket to attach the second member to a door 2 or door frame 4 so that the device may also pivot about that end. (See FIG. 2.) Functionally, the hold-open 10 can have either the first or second elongated member attached to the door frame, and either the first or second elongated member can be on top of the other.

Figure 4:
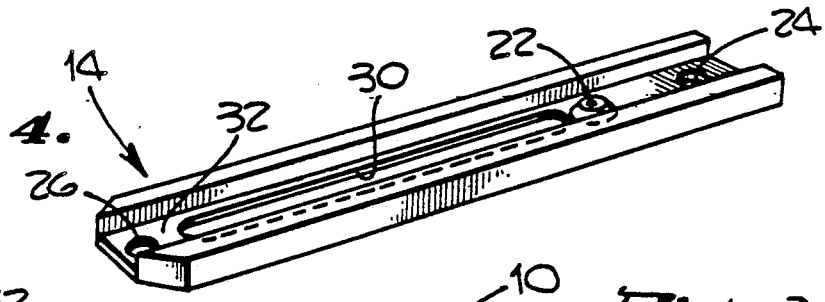
FIG. 4, is a perspective view of the second elongated member by itself.
Figure 3:
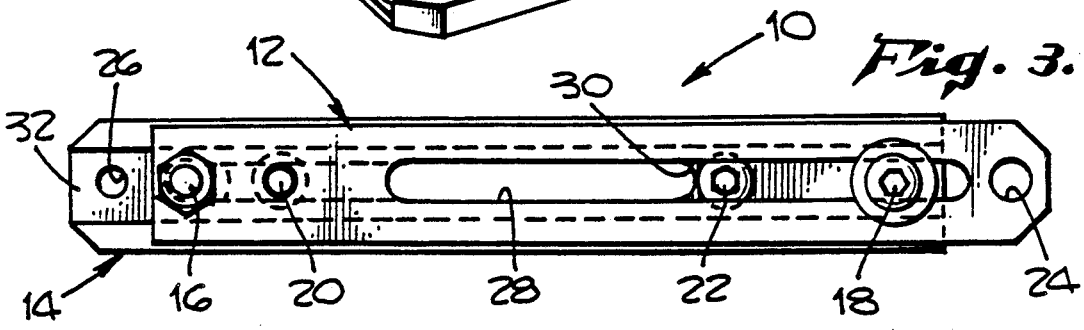
FIG. 3 is a top view of the device.

As can be more clearly seen in FIG. 3, the first elongated member 12 has a slot 28. The second elongated member 14 has a similar slot 30. The two elongated slots 28 and 30 preferably extend along a substantial portion of the length of each elongated member 12 and 14. Second elongated member 14 also includes a track 32 which is most clearly illustrated in FIG. 4. Track 32 is shown extending along the entire length of second elongated member 14, though alternatively the track 32 need only extend a sufficient distance to provide an area for the impediment 20 of the first elongated member 12 to travel. However, the present invention could be practiced without the use of any track. In that case, the two impediments 20 and 22 would ride directly on the inside surfaces of the opposing elongated member.

The first slidable connector 16 and the second slidable connector 18 are preferably of identical construction. The first connector is pictured in FIG. 9. The slidable connector includes a bolt 34 and a nut 36. The slidable connector further includes washers 38 and a resilient, compressible O-ring 40 located between the two washers. Each slidable connector serves as a guide and fastener function. The bolt (e.g. 34) serves as a guide rod for the guide by engaging the respective slots. The bolt and nut serve as the fasteners by maintaining the inside surfaces of the two elongated members in sliding contact. The O-ring 40 serves as the biasing member for biasing the two inside surfaces into contact with each other. The O-ring serves this function by being compressible and resilient, e.g. a rubber O-ring.

The first slidable connector 16 is fixedly attached to the first elongated member 12. The bolt 34 of the first slidable connector 16 passes through an appropriately sized aperture 42 in the first member. The aperture 42 is preferably threaded to mate with appropriate threads on the bolt 34. The bolt 34 also passes through the slot 30 of the second elongated member. The two washers 38 which sandwich the O-ring 40 are positioned between the head 44 of the bolt 34 and the second elongated member 14. A nut 36 is attached to the end of the bolt 34 which extends beyond the aperture 42 of the first elongated member. The second slidable connector 18 is fixedly attached to the second elongated member 12 in a similar fashion. The two slidable connectors serve as guides in that one guide is attached to each elongated member and each guide has a guide rod (e.g. bolt) which extends through the mating slot on the adjacent elongated member. The function of the two guides and their two guide rods is to maintain the linear relationship of the two elongated members.

The resilient, compressible O-rings 40, 41 bias the two elongated members towards each other. The amount of bias can be adjusted by loosening or tightening the bolts 34, 35.

Figures 5, 6, 7, 8, 9:
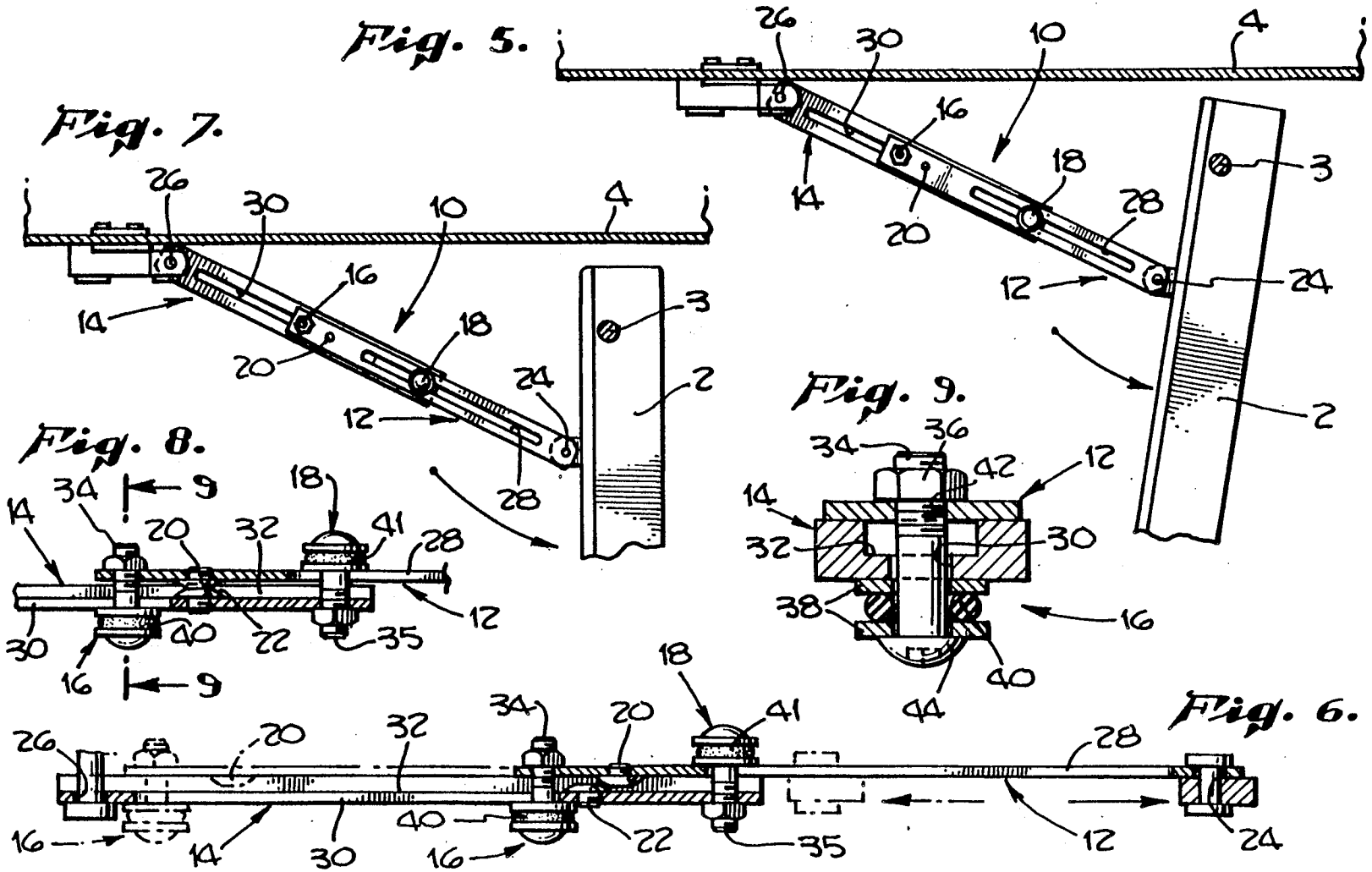
FIG. 5 is a top view, similar to FIG. 2 showing the operation of the device when the door is opened in the direction indicated by the arrow.
FIg. 6 is a side view of a device shown in its expanded state at the point just before the two impediments make contact.
FIG. 7 is an overhead view similar to FIG. 5 with a device shown at its hold-open point.
FIG. 8 is a detailed view of the device with the two impediments making contact.
FIG. 9 is a further detailed view taken along view 9—9 shown in FIG. 8. Detailed Description An exemplary preferred embodiment of the sliding door hold-open 10 of the present invention, is illustrated in FIGs. 1 through 9.

When a door which is outfitted with the device of the present invention, as shown in FIGS. 5 and 7, in a manner such as described above is opened, the first member 12 and the second member 14 pivot about openings 24 and 26 respectively while sliding along each other's inside surfaces in opposite directions. The slots in the two members in combination with the slidable connectors allow the members to only slide in a direction parallel to their longest axes. If the door 2 is opened far enough, the two impediments 20, 22 come into contact with each other. Sufficient force must then be exerted on the door 2, in the direction indicated by the arrow in FIG. 5, to compress the O-rings 40, 41 of the slidable connectors 16, 18 an amount sufficient to permit the first and second members to separate far enough to allow the two impediments to ride over each other as shown in FIG. 8. Once the two impediments have ridden over each other, the device is in its fully open position, FIG. 7, and will hold the door in that open position until a force sufficient to force the two impediments to again ride over each other in the opposite direction is applied to the door.

The amount of force necessary to cause the two impediments to ride over each other can be varied by varying the size or height of the impediments, by varying the resiliency of the O-rings, and by varying how tightly the slidable connectors are fastened.

Preferably the impediments 20 and 22 are small, threaded bolts or screws which are screwed into appropriately threaded apertures (not shown) in the first and second elongated members. This allows for easy replacement of the impediments if they become worn and is also less expensive than milling, grinding or forging impediments directly on the members themselves.

It should also be noted that means other than the bolt, nut, washer, O-ring combination can be used for the slidable connectors. For example, cotter pins could replace the bolts and nuts, as could rivets. The O-rings could be replaced with metal or plastic springs. Also, one or both of the washers could be eliminated, especially if the O-ring was made from a compressible, resilient material which also had a low coefficient of friction.

It should also be noted that the first elongated member 12 is preferably thinner than the second elongated member and acts in a spring-like fashion exerting a biasing force first forcing the impediment which is connected to the first member against the impediment which is connected to the second member 14 but allowing the impediment connected to the first member to ride over the impediment connected to the second member when a force sufficient to overcome the biasing force is applied.

By now, skilled practitioners will recognize that other modifications of the instant invention are possible in terms of materials, methods of manufacture, and assembly, depending on the particular application at hand. Accordingly, the embodiments illustrated and discussed in the accompanying specification and drawings should be taken as exemplary in nature and the scope and spirit of the instant invention should be limited only by the following claims.

What is claimed is:

1. A hold-open for a door hingeably attached to a door frame, comprising:

a first elongated member having an inside surface, an elongated slot extending along a substantial portion of the length of the elongated member, and a raised impediment located on said inside surface between one end of the slot and the proximate end of the elongated member;

a second elongated member having an inside surface, an elongated slot extending along a substantial portion of the length of the elongated member, and a raised impediment located on said inside surface between one end of the slot and the proximate end of the elongated member; and a first guide attached to the first elongated member and a second guide attached to the second elongated member, wherein each guide includes a guide rod which engages the slot in the adjacent elongated member.

2. The hold-open defined in claim 1 wherein said second elongated member includes a track extending along the length of the inside surface of the elongated member and having a sufficient depth such that the two impediments slide freely within the track until they abut one another.

3. The hold-open defined in claim 1 wherein each guide includes a fastener to maintain the inside surfaces of the two elongated members in sliding contact.

4. The hold-open defined in claim 3 wherein the two inside surfaces of the elongated members which slide over one another are biased towards each other.

5. The hold-open defined in claim 3 wherein the two fasteners include a compressible, resilient member which biases the two inside surfaces against each other and is sufficiently compressible to allow the inside surfaces to separate sufficiently to permit the two impediments to ride over each other when a predetermined force is applied to slide the hold-open to its extended position.

6. The hold-open defined in claim 5 wherein the compressible, resilient members are O-rings.

7. A sliding hold-open for a door hingeably attached to a door frame, comprising:

a first elongated member having a guiding slot and a raised impediment located beyond the end of said slot;

a second elongated member having a guiding slot and a raised impediment located within said track beyond said slot;

a first slidable attachment means attached to one end of said first elongated member and extending through said slot of said second elongated member for slideably attaching said first elongated member to said second elongated member and for allowing said impediments to ride over one another when sufficient longitudinal force is applied to said elongated members; and a second slidable attachment means attached to one end of said second elongated member and extending through said slot of said first elongated member for slideably attaching said second elongated member to said first elongated member and for allowing said impediments to ride over one another when sufficient longitudinal force is applied to said elongated members.

8. The hold-open as defined in claim 7 wherein said first and second slidable attachment means include compressible O-rings.

9. A sliding hold-open as defined in claim 8 wherein said first slideable attachment means further includes a bolt having a head and passing through said slot of said second elongated member and being attached to said first elongated member with said compressible O-ring being located between said head of said bolt and said second elongated member; and wherein said second slidable attachment means further includes a bolt having a head which passes through said slot of said first elongated member and is attached to said second elongated member with said compressible O-ring located between said head of said bolt and said first elongated member.

10. A sliding hold-open for a door hingeably attached to a door frame, comprising:

a first elongated member having an inside surface, a guiding slot and a raised impediment located on an inside surface beyond the end of said slot;

a second elongated member having an inside surface, a track on said inside surface within which are located a guiding slot and a raised impediment which is beyond the end of said slot; and a first slideable connector attached to one end of said first elongated member and extending through said slot of said second elongated member and including a resilient compressible member; and a second connector attached to one end of said second elongated member and extending through said slot of said first elongated member and including a compressible member whereby the compressible members of said first and second connector bias said first member and said second member toward each other.

* * * * *